US007025599B1

(12) United States Patent
Wang

(10) Patent No.: US 7,025,599 B1
(45) Date of Patent: Apr. 11, 2006

(54) SURFACE MOUNT ASSEMBLY (SMA) RIGHT ANGLE CONNECTOR

(76) Inventor: Hsing-Tzu Wang, No. 80, Ta-Hsin St., Hsi Dist., Taichung City (TW)

( * ) Notice: Subject to any disclaimer, the term of this patent is extended or adjusted under 35 U.S.C. 154(b) by 0 days.

(21) Appl. No.: 11/069,729

(22) Filed: Feb. 28, 2005

(51) Int. Cl.
*H01R 12/00* (2006.01)

(52) U.S. Cl. ..... 439/63; 439/752.5

(58) Field of Classification Search ..... 439/63, 439/581, 578, 79, 752.5
See application file for complete search history.

(56) References Cited

U.S. PATENT DOCUMENTS 4,360,244 A * 11/1982 Forney et al. ..... 439/581
5,088,937 A * 2/1992 Gabany ..... 439/581

* cited by examiner

*Primary Examiner*—Tho D. Ta
*Assistant Examiner*—Vanessa Girardi
(74) *Attorney, Agent, or Firm*—Christensen O'Connor Johnson Kindness PLLC

(57) ABSTRACT

A surface mount assembly (SMA) right angle connector includes a hollow housing having an L-shaped inner wall with a first part defining a first channel and a second part transverse to the first part and defining a second channel, an L-shaped rod that has first and second segments which are transverse to each other, and a rod-insertion mechanism that has a first groove formed in the first part and in spatial communication with the first channel, and a second groove formed in the second part and in spatial communication with the second channel. The first and second grooves are disposed at a long side of the inner wall so as provide an extra space for extension of the L-shaped rod into the housing to a mounting position.

4 Claims, 12 Drawing Sheets

SURFACE MOUNT ASSEMBLY (SMA) RIGHT ANGLE CONNECTOR

BACKGROUND OF THE INVENTION

1. Field of the Invention

The invention relates to a connector, more particularly to a surface mount assembly (SMA) right angle connector.

2. Description of the Related Art

Surface mount assembly (SMA) connectors are normally installed on a printed circuit board for connecting to a device, such as an antenna. The SMA connectors are categorized according to their shapes: straight (abbreviated as STR) connectors, right angle (abbreviated as R/A) connectors, and connectors with particular shapes, such as a T-shape connector. It is known in the art that assembly of the right angle connectors can encounter a technical problem. The conventional right angle SMA connector includes an L-shaped housing and a conductive L-shaped rod mounted in the L-shaped housing. Since the conductive rod is L-shaped, the L-shaped housing normally comprises two pieces which are assembled together after insertion of the L-shaped rod into one of the pieces.

Referring to FIG. 1, a conventional connector 10 is shown to include a housing 11, a threaded part 12, a bent rod 13, and a pair of insulator sleeves 14. The housing 11 has four posts 111 extending from a bottom of the housing 11, and is formed with a first hole 112 and a second hole 113 transverse to and in spatial communication with the first hole 112. The threaded part 12 is formed with a third hole 121, and includes a thread segment 122 and an engaging segment 123 that extends from the threaded segment 122 and that is snugly fitted into the second hole 113 in the housing 11. The bent rod 13 is made from a conductive material. During assembly, one end of the bent rod 13 is inserted into and through the first and second holes 112. The engaging segment 123 is then inserted into the second hole 113 in the housing 11 in a manner that the end of the bent rod 13 extends outwardly of the third hole 121. The insulator sleeves 14 are subsequently sleeved on the ends of the bent rod 13.

Referring to FIG. 2, another conventional connector 20 is shown to include a housing 21, a mounting part 22, a bent rod 23, and a pair of insulator sleeves 24. The housing 21 is formed with a first hole 213 at a bottom of the housing 21, and has a threaded engaging part 211 extending from a lateral side of the housing 21. The threaded engaging part 211 is formed with a second hole 212 in spatial communication with the first hole 213. The mounting part 22 is formed with a third hole 221, and includes four posts 222 extending from a bottom side of the mounting part 22, and a tubular connecting part 223 extending from a top side of the mounting part 22 and defining the third hole 221. The connecting part 223 is snugly fitted into the first hole 213 in the housing 21. The bent rod 23 is made from a conductive material. During assembly, one end of the bent rod 23 is inserted into and through the first and second holes 213, 212. The connecting part 223 is then inserted into the first hole 213 in the housing 21. The insulator sleeves 24 are subsequently sleeved on the ends of the bent rod 23.

The conventional connectors 10, 20 are disadvantageous in that the housing 11 and the threaded part 12 or the housing 21 and the mounting part 22 tend to be undesirably disconnected by an external force. Moreover, since the housing 11 and the threaded part 12 or the housing 21 and the mounting part 22 are two separated pieces, the same are required to be assembled together during production of the connectors, which results in an increase in the manufacturing costs.

SUMMARY OF THE INVENTION

Therefore, the object of the present invention is to provide a surface mount assembly (SMA) connector that can overcome the aforeaid drawbacks associated with the prior art.

According to the present invention, there is provided a surface mount assembly (SMA) connector that comprises: a hollow housing having first and second open ends, and an L-shaped inner wall that extends from the first open end to the second open end of the housing and that has a first part extending from the first open end and defining a first channel, and a second part extending from the first part to the second open end and defining a second channel which is transverse to and which extends from the first channel, the inner wall having an L-shaped long side and an L-shaped short side that is opposite to the long side and that has a length less than that of the long side; an L-shaped rod that has first and second segments which are transverse to each other; and a rod-insertion mechanism that has a first groove formed in the first part of the inner wall and in spatial communication with the first channel, and a second groove formed in the second part of the inner wall and in spatial communication with the second channel. The first and second grooves are disposed at the long side of the inner wall so as provide an extra space for extension of the L-shaped rod into the housing to a mounting position, wherein the first segment of the L-shaped rod is disposed in the first channel, and the second segment of the L-shaped rod is disposed in the second channel.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Referring to FIGS. 3 to 7, the first preferred embodiment of a surface mount assembly (SMA) connector according to the present invention is shown. The SMA connector is adapted to be mounted on a printed circuit board of a wireless network base station device for connection to an antenna. It should be noted that the first preferred embodiment is not only limited to application in wireless communication products, and can be used in other applications.

Figure 1:
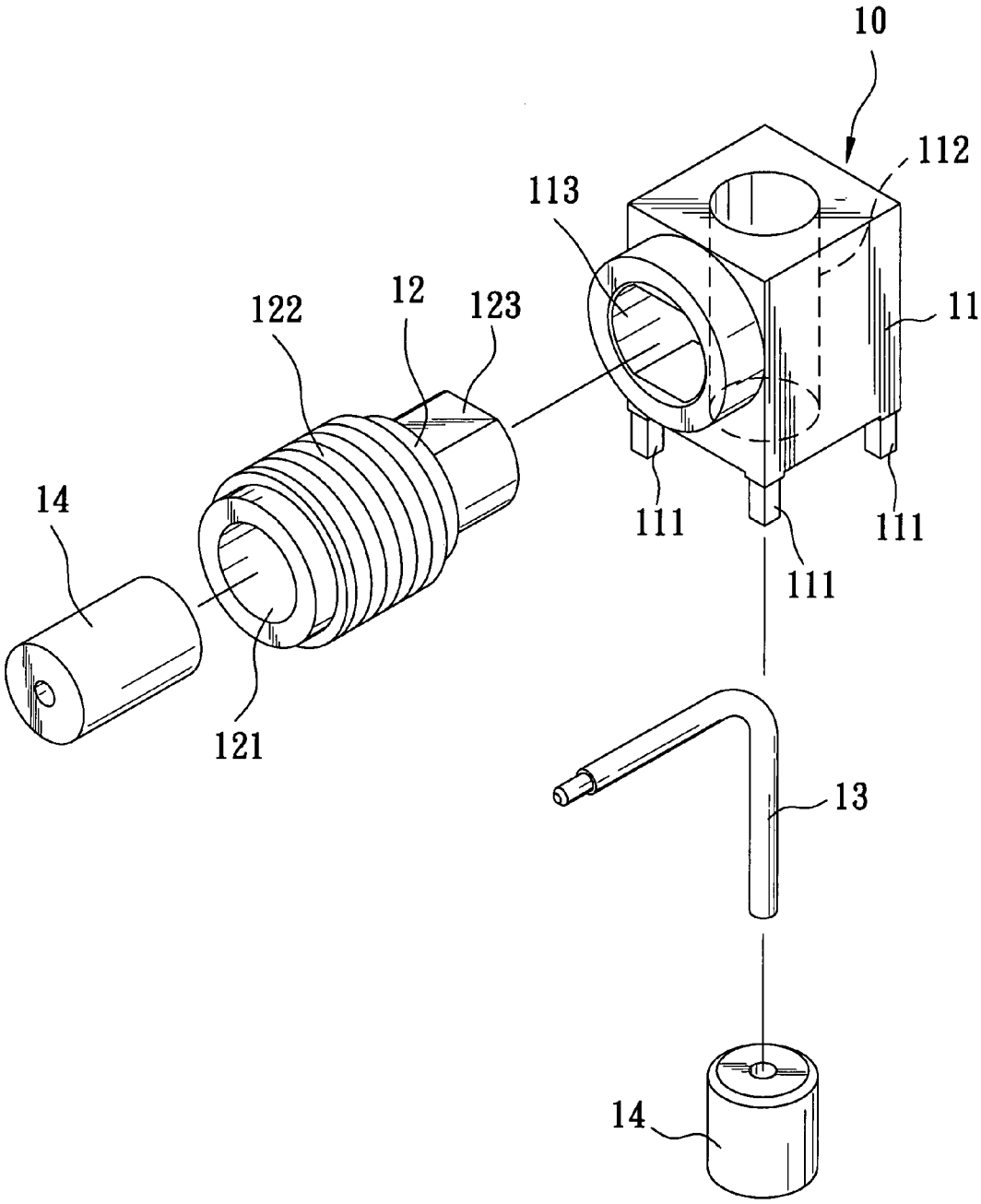
FIG. 1 PRIOR ART
FIG. 1 is an exploded perspective view of a conventional surface mount assembly (SMA) connector.
Figure 2:
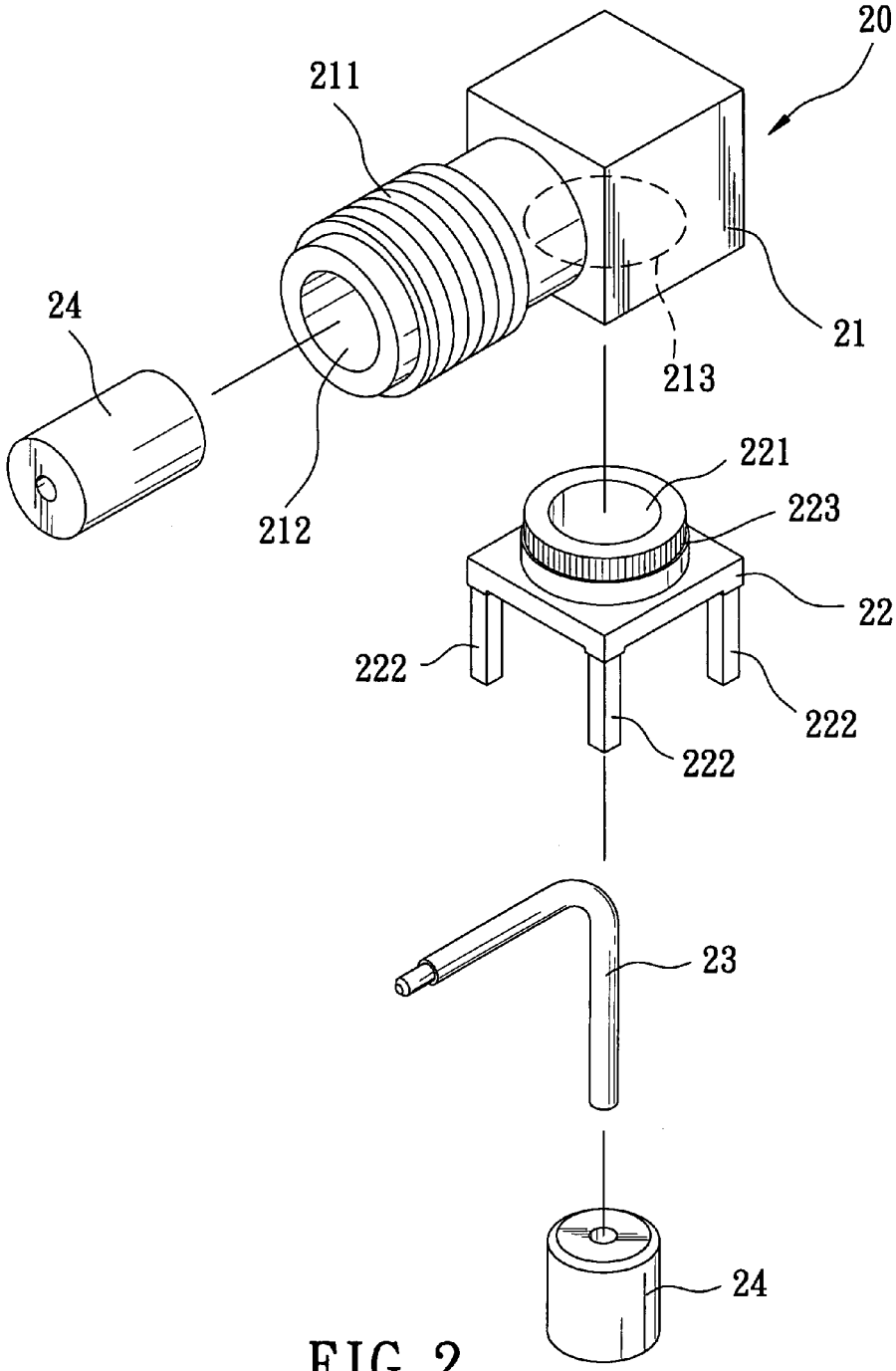
FIG. 2 PRIOR ART
FIG. 2 is an exploded perspective view of another conventional SMA connector.
Figure 3:
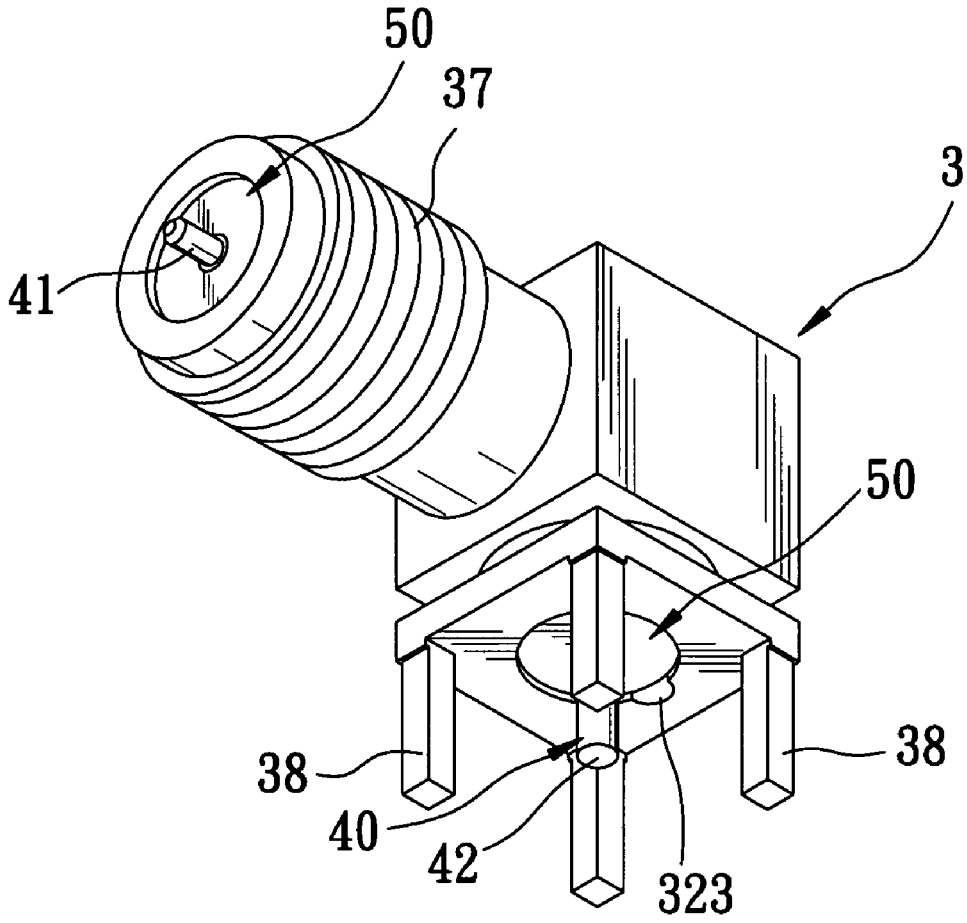
FIG. 3 is an assembled perspective view of the first preferred embodiment of a SMA connector according to the present invention.
Figure 4:
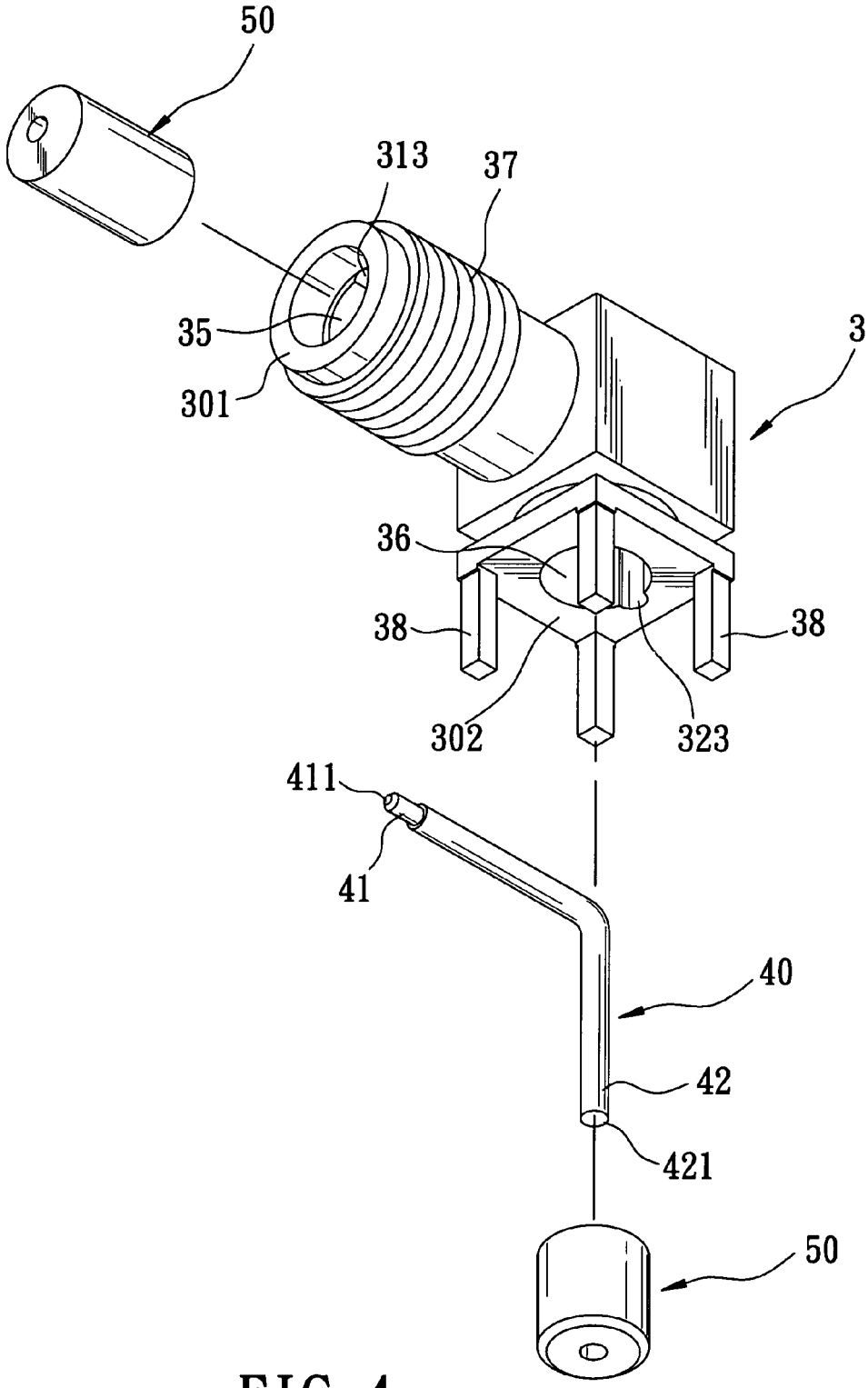
FIG. 4 is an exploded perspective view of the first preferred embodiment of the SMA connector according to the present invention.
Figure 5:
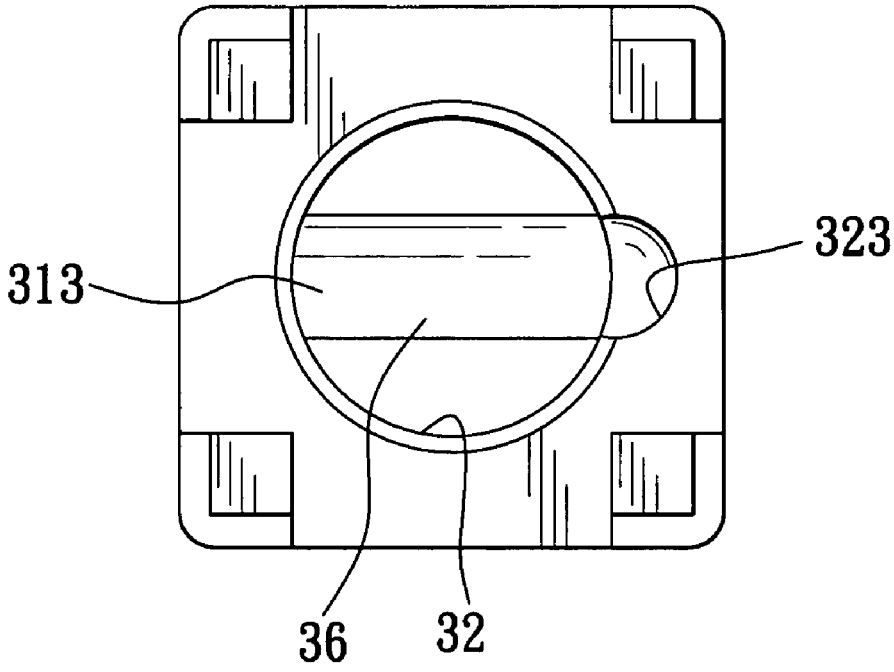
FIG. 5 is a schematic bottom view of the first preferred embodiment.
Figure 6:
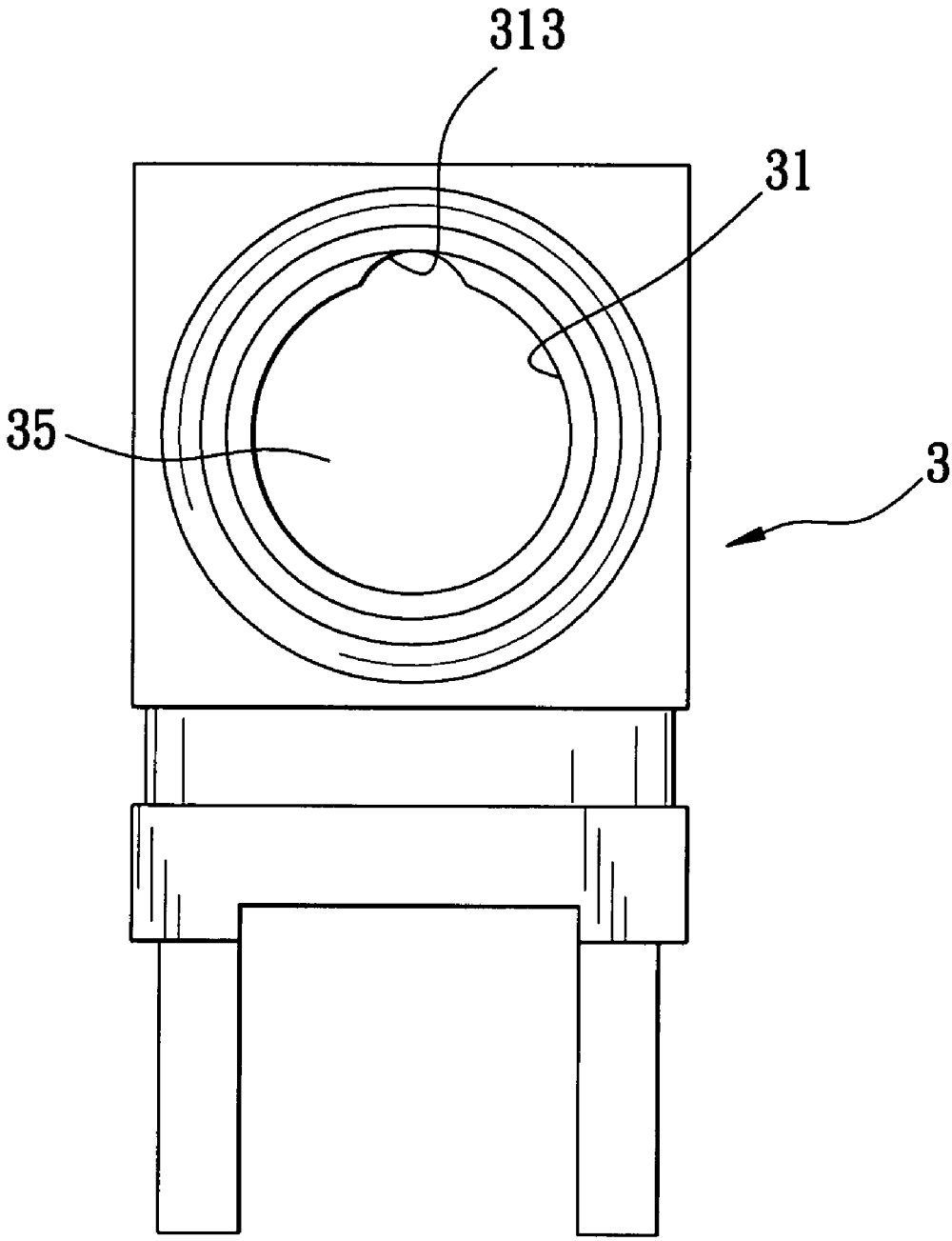
FIG. 6 is a schematic side view of the first preferred embodiment.
Figure 7:
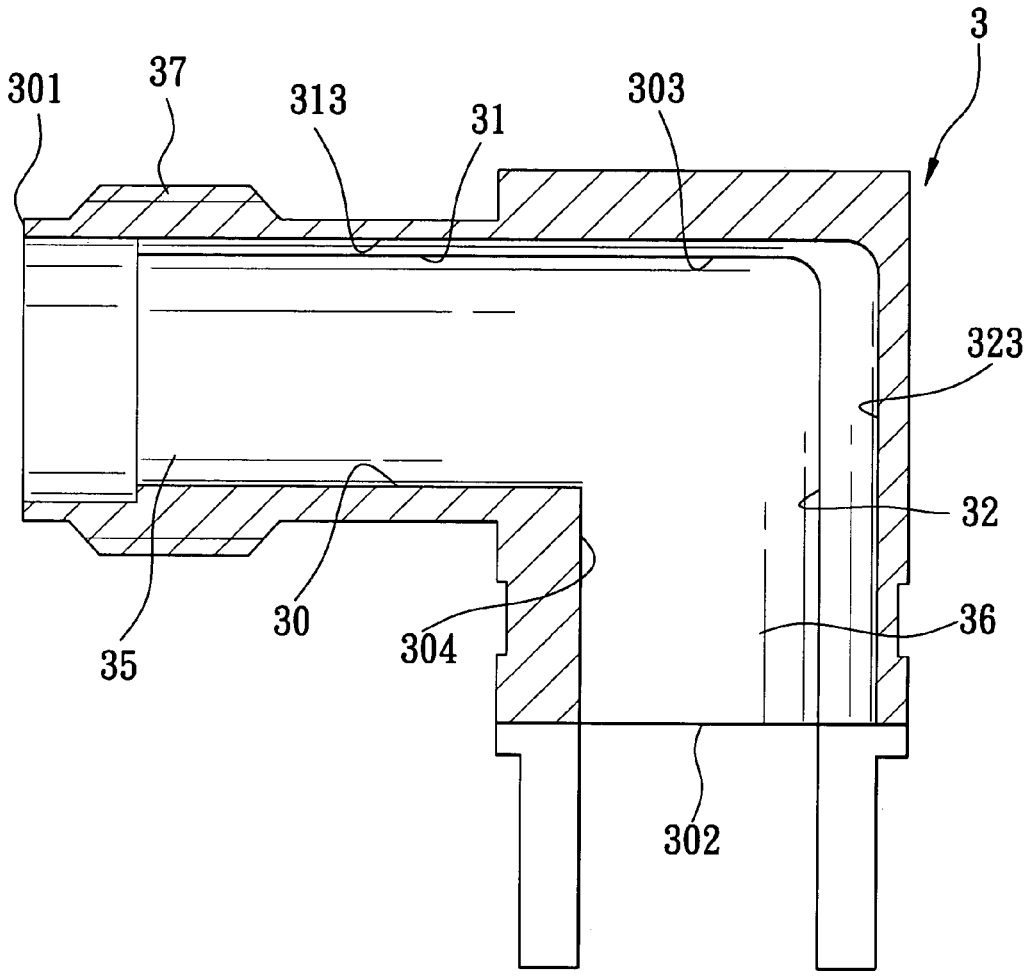
FIG. 7 is a schematic sectional view of the first preferred embodiment.
Figure 8:
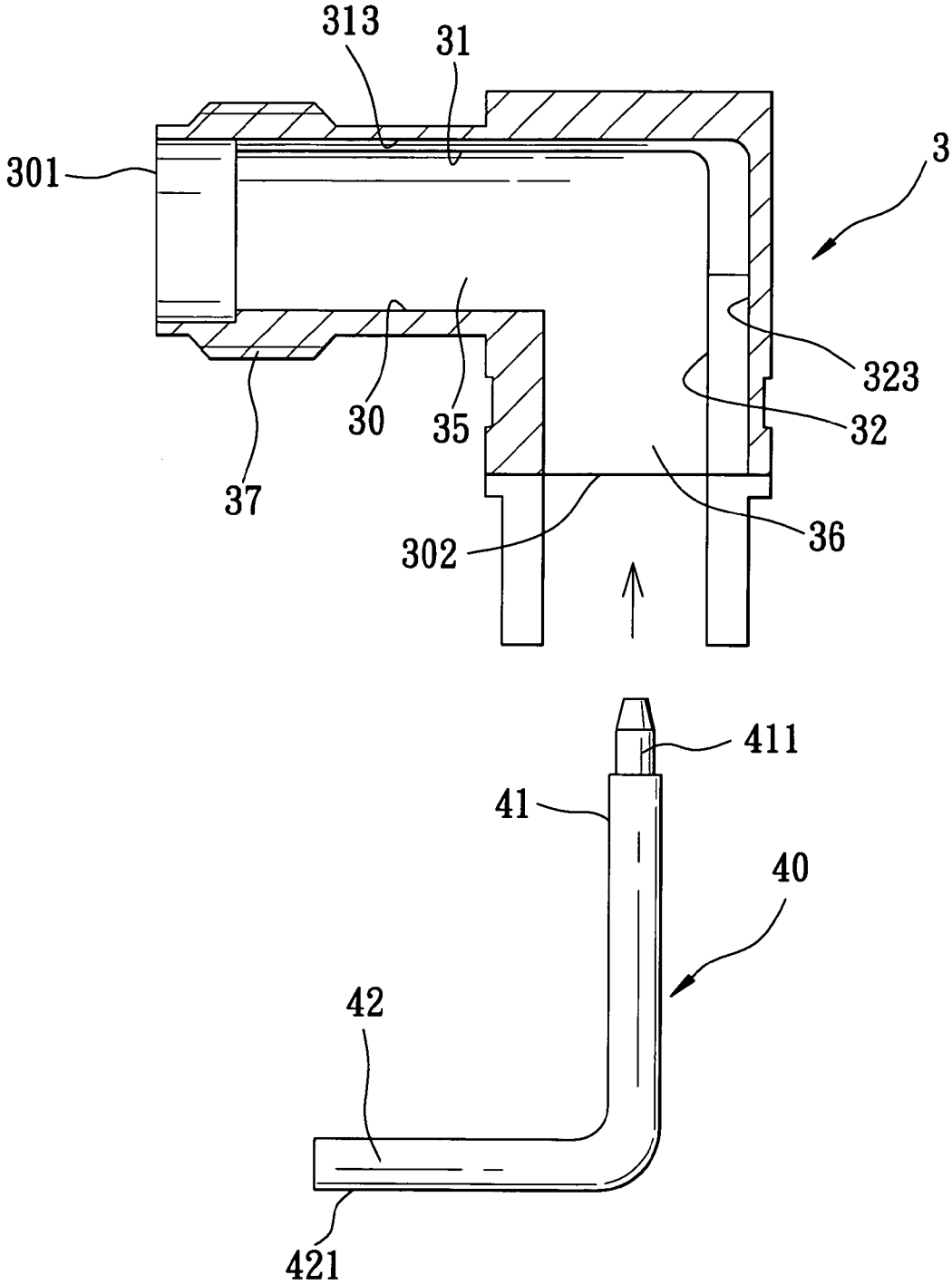
FIGS. 8 to 11 are schematic sectional views to illustrate how an L-shaped rod is inserted into an L-shaped housing with assistance from a rod-insertion mechanism.
Figure 9:
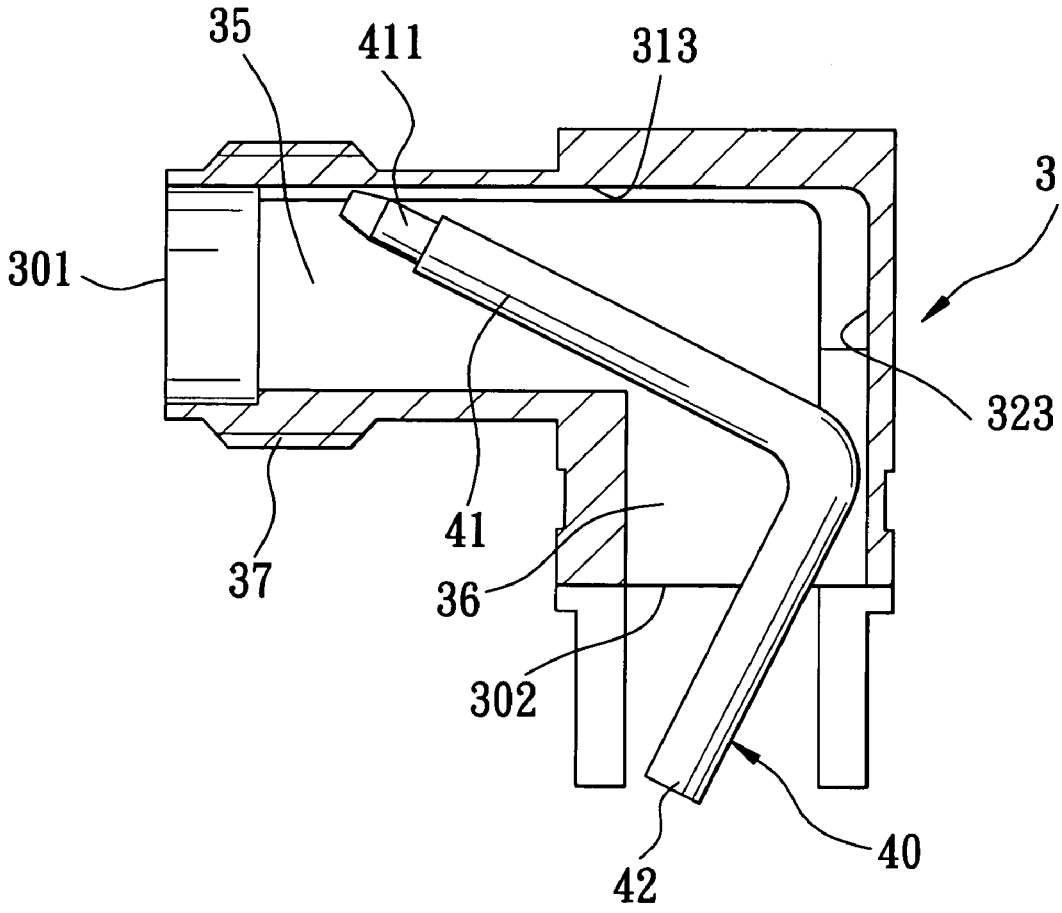
Figure 10:
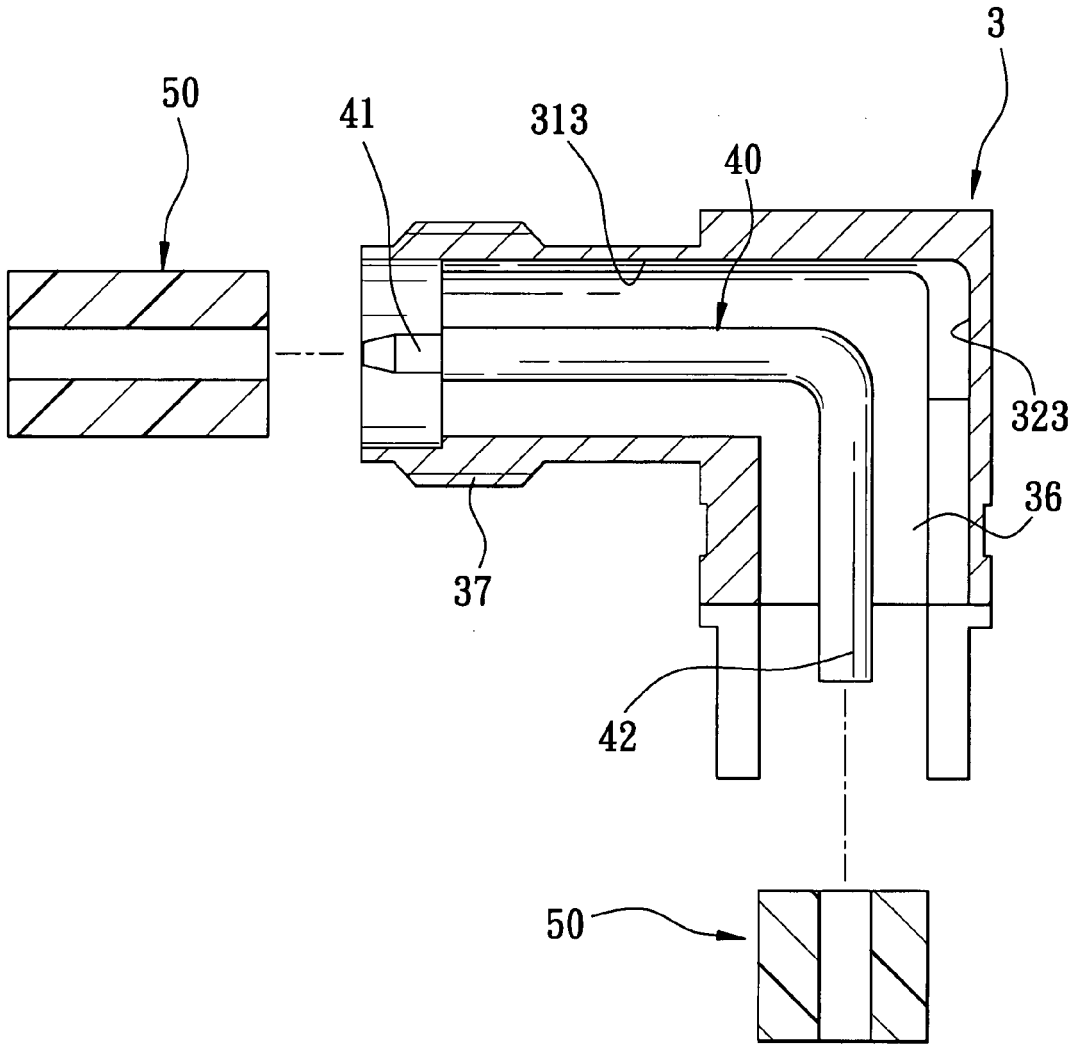
Figure 11:
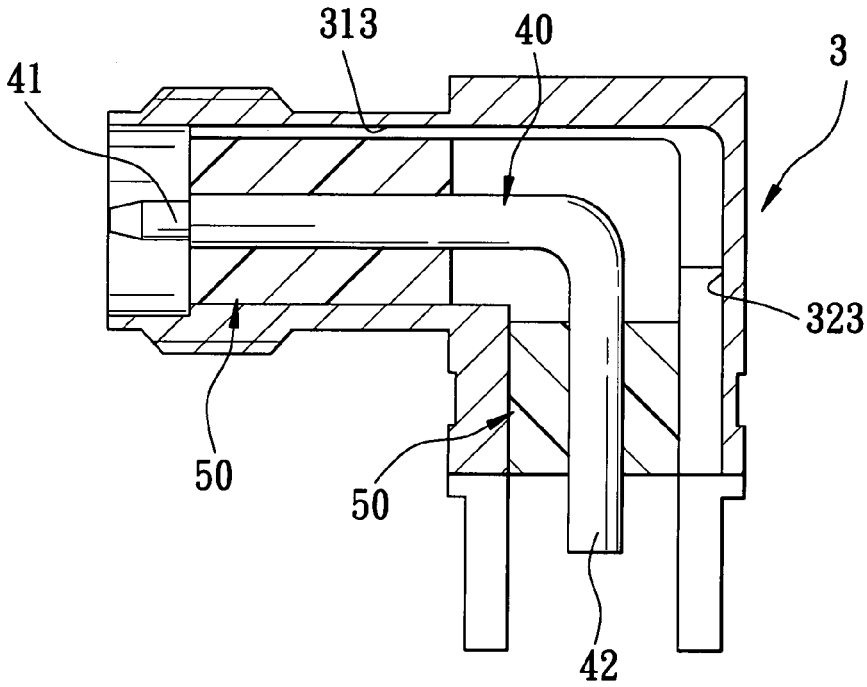

The SMA right angle connector includes: a hollow housing 3 having first and second open ends 301, 302, and an L-shaped inner wall 30 that extends from the first open end 301 to the second open end 302 of the housing 3 and that has a first part 31 extending from the first open end 301 and defining a first channel 3, and a second part 32 extending from the first part 31 to the second open end 302 and defining a second channel 36 which is transverse to and which extends from the first channel 35, the inner wall 30 having an L-shaped long side 303 and an L-shaped short side 304 that is opposite to the long side 303 and that has a length less than that of the long side 303; an L-shaped rod 40 that has first and second segments 41, 42 which are transverse to each other; and a rod-insertion mechanism that has a first groove 313 formed in the first part 31 of the inner wall 30 and in spatial communication with the first channel 35, and a second groove 323 formed in the second part 32 of the inner wall 30 and in spatial communication with the second channel 36. The first and second grooves 313, 323 are disposed at the long side 303 of the inner wall 30 so as to provide an extra space for extension of the L-shaped rod 40 into the housing 3 to a mounting position, wherein the first segment 41 of the L-shaped rod 40 is disposed in the first channel 35, and the second segment 42 of the L-shaped rod 40 is disposed in the second channel 36 (see FIGS. 8 to 10). The housing 3 is in the form of a single piece, and is formed with a plurality of posts 38 extending from the second open end 302 of the housing 3 for mounting on a printed circuit board (not shown).

In this embodiment, the first groove 313 extends from the first open end 301 of the housing 3, while the second groove 323 extends from the second open end 302 of the housing 3. The first and second grooves 313, 323 are joined together at a juncture between the first and second parts 31, 32 of the inner wall 30.

The housing 3 further has an outer surface that is formed with an outer thread 37 which surrounds the first part 31 of the inner wall 30 and which is adapted to be connected to an external cable or an external antenna (not shown).

Each of the first and second segments 41, 42 of the L-shaped rod 40 has a contact end 411 (421). The SMA right angle connector further includes a pair of insulator sleeves 50, each of which is inserted into the housing 3 through a respective one of the first and second open ends 301, 302 of the housing 3 and each of which is sleeved on the contact end 411, 412 of a respective one of the first and second segments 41, 42 of the L-shaped rod 40.

During assembly, referring to FIGS. 8 to 11, since the length of the second part 32 of the inner wall 30 of the housing 3 is shorter than that of the first part 31, the first segment 41 of the L-shaped rod 40 is selected to be first inserted into the second channel 36 through the second open end 302 of the housing 3. When the contact end 411 of the first segment 41 of the L-shaped rod 40 reaches the first channel 35, the L-shaped rod 40 must be operated in an inclined position so as to progress further. As shown in the FIG. 9, to guide further extension of the L-shaped rod 40 into the housing 3, the first and second grooves 313, 323 respectively receive the contact end 411 of the first segment 41 of the L-shaped rod 40 and a corner of the first and second segments 41, 42 of the L-shaped rod 40, such that the extra space provided by the first and second grooves 313, 323 is sufficient to allow the L-shaped rod 40 to turn slightly within the first and second channels 35, 36, thereby permitting the first segment 41 of the L-shaped rod 40 to be fully extended into the first channel 35. The insulator sleeves 50 are respectively sleeved on the contact end 411 of the first segment 41 and the contact end 421 of the second segment 42 of the L-shaped rod 40 after the L-shaped rod 40 is moved to the mounting position.

Figure 12:
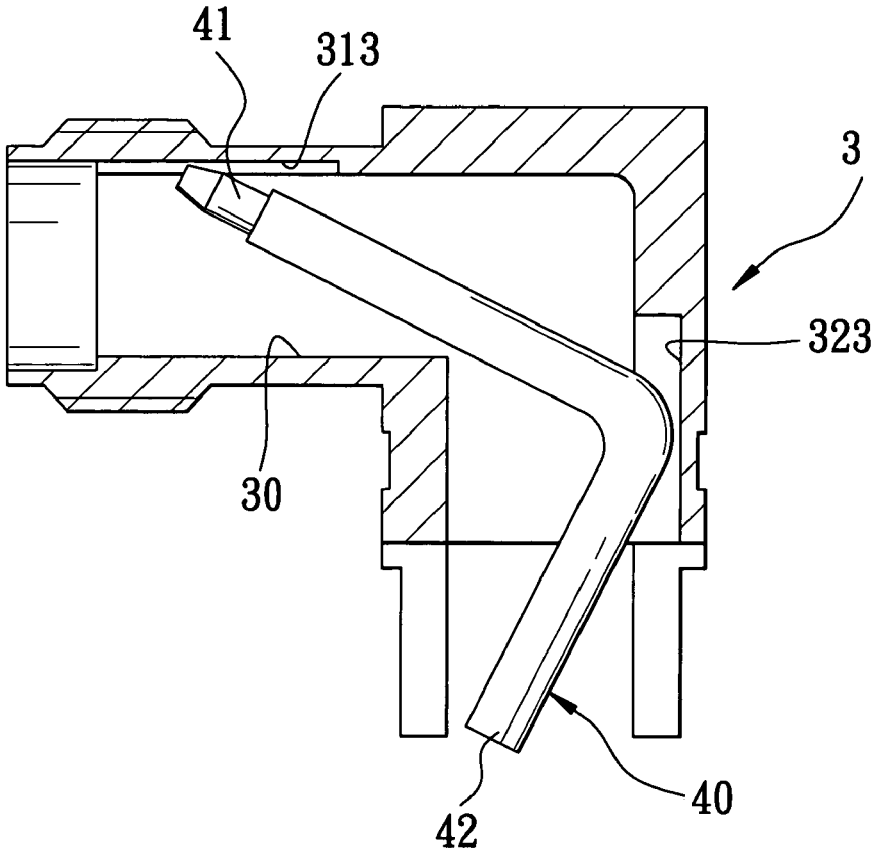
FIG. 12 is a schematic sectional view of the second preferred embodiment of the SMA connector according to this invention.

FIG. 12 illustrates the second preferred embodiment according to this invention. The SMA right angle connector of this embodiment differs from the previous embodiment in that each of the first and second grooves 64, 63 only extends to a middle position between two ends of a respective one of the first and second parts 31, 32 of the inner wall 30.

In sum, assembly of the surface mount assembly (SMA) right angle connector of this invention is easy to conduct, and manufacturing costs can be significantly reduced. While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A surface mount assembly (SMA) right angle connector comprising:

a hollow housing having first and second open ends, and an L-shaped inner wall that extends from said first open end to said second open end of said housing and that has a first part extending from said first open end and defining a first channel, and a second part extending from said first part to said second open end and defining a second channel which is transverse to and which extends from said first channel, said inner wall having an L-shaped long side and an L-shaped short side that is opposite to said long side and that has a length less than that of said long side;

an L-shaped rod that has first and second segments which are transverse to each other; and a rod-insertion mechanism that has a first groove formed in said first part of said inner wall and in spatial communication with said first channel, and a second groove formed in said second part of said inner wall and in spatial communication with said second channel, said first and second grooves being disposed at said long side of said inner wall so as to provide an extra space for extension of said L-shaped rod into said housing to a mounting position, wherein said first segment of said L-shaped rod is disposed in said first channel and said second segment of said L-shaped rod is disposed in said second channel.

2. The SMA right angle connector of claim 1, wherein said first groove extends from said first open end of said housing, said second groove extending from said second open end of said housing, said first and second grooves joining together at a juncture between said first and second parts of said inner wall.

3. The SMA right angle connector of claim 1, wherein said housing further has an outer surface that is formed with an outer thread which surrounds said first part of said inner wall.

4. The SMA right angle connector of claim 1, wherein each of said first and second segments of said L-shaped rod has a contact end, said SMA right angle connector further comprising a pair of insulator sleeves, each of which is inserted into said housing through a respective one of said first and second open ends of said housing and each of which is sleeved on said contact end of a respective one of said first and second segments of said L-shaped rod.

* * * * *